United States Patent [19]

Kristensen

[11] Patent Number: 5,059,035

[45] Date of Patent: Oct. 22, 1991

[54] FLEXIBLE POUCH WITH FOLDED SPOUT

[75] Inventor: Knud N. Kristensen, Fair Haven, N.J.

[73] Assignee: Colgate-Palmolive Company, Piscataway, N.J.

[21] Appl. No.: 478,882

[22] Filed: Feb. 12, 1990

[51] Int. Cl.[5] ..... B65D 33/38

[52] U.S. Cl. ..... 383/33; 383/104; 383/906; 222/572; 222/575

[58] Field of Search ..... 383/33, 47, 104, 904, 383/906; 222/526, 527, 572, 574, 575

[56] References Cited

U.S. PATENT DOCUMENTS

| | | | |
|---|---|---|---|
| 1,787,710 | 1/1931 | Wilson | 383/906 X |
| 2,866,488 | 12/1958 | Thompson | 383/906 X |
| 2,998,340 | 8/1961 | Conway et al. | 383/906 X |
| 2,999,627 | 9/1961 | Reinhardt | 383/906 X |
| 3,171,581 | 3/1965 | Kugler | 383/906 X |
| 3,318,505 | 5/1967 | Garrison et al. | 222/572 X |
| 3,473,703 | 10/1969 | Lippincott | 222/215 |
| 3,502,521 | 3/1970 | Doyen et al. | 383/906 X |
| 3,663,239 | 5/1972 | Rowe et al. | 383/906 X |

FOREIGN PATENT DOCUMENTS

| | | | |
|---|---|---|---|
| 572976 | 9/1962 | Belgium | 383/906 |

*Primary Examiner*—Stephen Marcus
*Assistant Examiner*—Jes F. Pascua
*Attorney, Agent, or Firm*—Michael J. McGreal; Robert C. Sullivan; Murray M. Grill

[57] ABSTRACT

A flexible pouch having opposed walls closed around their periphery to define a chamber for storing a product. The pouch has a self-opening spout forming in part by a fold assembly which expands and springs open when the sealed end of the spout is cut off. The fold assembly not only provides a large spout opening, but also provides a spring force which keeps the spout open so that all the product may be emptied from the chamber.

17 Claims, 3 Drawing Sheets

FLEXIBLE POUCH WITH FOLDED SPOUT

BACKGROUND OF THE INVENTION

This invention relates generally to a flexible pouch constructed of laminated plastic material used for dispensing containers with a fluid product and in particular to a flexible pouch having a novel self opening spout arrangement to facilitate pouring of all the product from the pouch. More particularly, this invention relates to dispensing containers which are used to refill other containers.

Conventional flexible pouches having a spout for pouring liquid stored therein are disclosed in U.S. Pat. Nos. 3,171,581, 3,907,164 4,285,376, 4,332,344, 4,491,245, 4,578,813 and Re 24,251. While pouches of this type have become very popular, particularly for environmental considerations, they suffer a common disadvantage that the spout of those pouches has a tendency to close upon itself during the pouring operation which blocks the discharge of the liquid through the spout. As a result it is difficult to empty all the liquid from the pouch.

One attempt to overcome this problem is disclosed in U.S. patent application Ser. No. 327,659 filed on Mar. 23, 1989 and assigned to the same assignee as this application. The proposal set forth in that application represents a substantial improvement over the prior art. In similar fashion the invention as set forth in this application and described below provides a novel self opening spout design having an enlarged pouring opening which stays open as the liquid is emptied from the pouch.

SUMMARY OF THE INVENTION

The primary object of this invention resides in the provision of a flexible pouch having a novel self opening spout that opens quickly and remains open as all the liquid is poured from the pouch.

Another object of the invention resides in the provision of the above pouch wherein a portion of the spout includes a fold assembly which provides a resilient spring force for opening the spout when its sealed edge is cut. The spring force also keeps the spout open so that all the liquid in the pouch may be emptied therefrom.

Still another object of the invention resides in the provision of the above described pouch wherein a portion of at least one of the walls of the pouch is doubled inwardly upon itself and forms part of the spout, the portion springing open when the front sealed edge of the spout is cut off to provide a large opening through which all the liquid in the pouch may be poured therefrom.

A further object of the invention resides in the provision of a pouch having the above described novel self-opening spout wherein the upper portion of the spout includes a fold assembly which produces an opening spring force when the sealed edge of the spout is cut off.

Another object of the invention is to provide the above described pouch which includes a recess immediately below the spout, the recess facilitating the pouring of the liquid through the spout into containers having various neck diameters.

These and other objects and advantages will become apparent as the description proceeds in connection with the accompanying drawings.

DETAILED DESCRIPTION OF THE INVENTION

Figure 1:
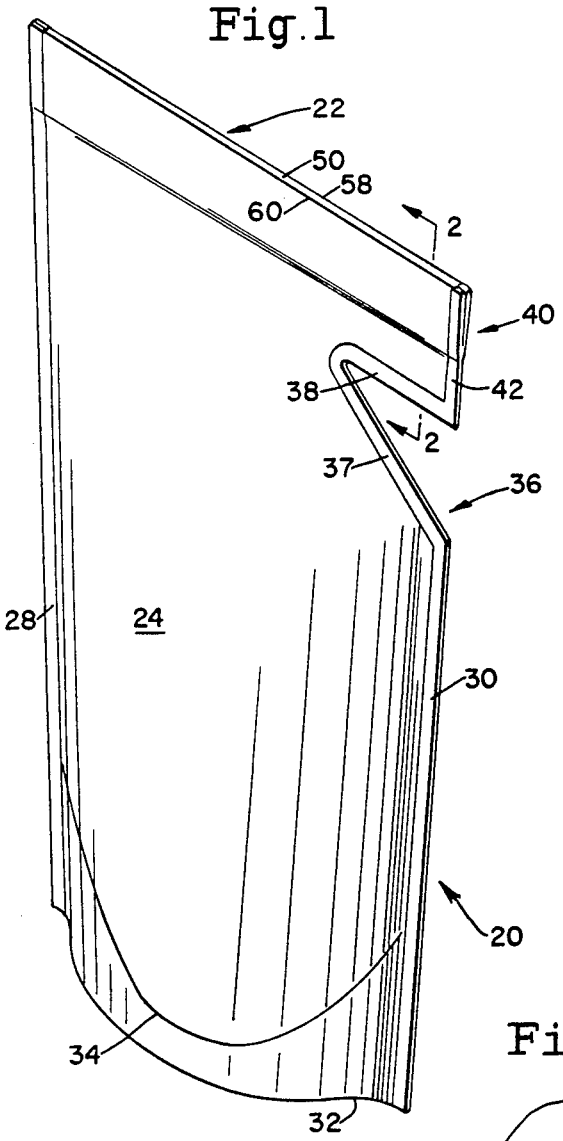
FIG. 1 is a side perspective view of a flexible pouch illustrating a first embodiment of the novel pouring spout of the invention in its sealed closed condition.

Referring now to FIG. 1 pouch 20 is formed from a single sheet of flexible plastic material folded over at its top end edge 22 to provide opposing front and back walls 24 and 26 sealed together peripherally along their side edges 28 and 30 and bottom edge 32 to form a closed inner chamber. The bottom edge of the pouch is gussetted along contour 34 to enable the pouch to stand upright when the inner chamber is filled with liquid.

The wall material is preferably transparent or translucent plastic of a type which will not react with the ingredients in the liquid to be stored in the pouch chamber. The peripheral edges of the material are bonded together by heat sealing, dielectric welding, sonic welding, adhesive, or other suitable means to form the closed inner chamber of the pouch.

The side edge 30 includes a recessed section 36 having an upwardly and inwardly inclined sealed edge 37 terminating in a lateral sealed edge 38 spaced below top edge 22 so that the upper portions of walls 24 and 26 between top edge 22 and edge 38 define a pouring spout 40 at a corner of the pouch.

Figure 3:
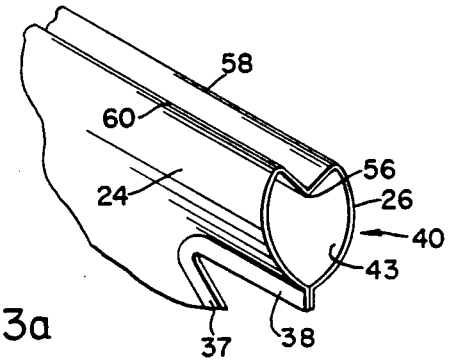
FIG. 3 is a fragmentary side perspective view illustrating the spout of FIG. 1 in its open pouring condition.
Figure 3A:
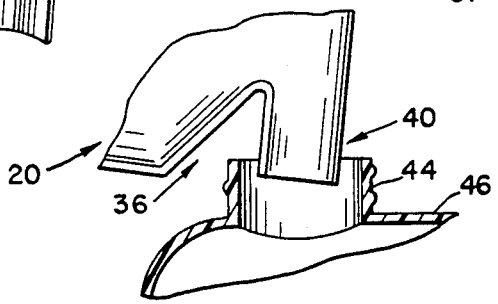
FIG. 3A is a fragmentary side perspective view of the pouch illustrating the manner in which the liquid is poured into another rigid container.

To pour the liquid from the pouch, the sealed edge 42 of spout 40 is cut off to form opening 43 and the spout is inserted into the open neck 44 of a rigid container 46 (FIG. 3A). Recess 36 conveniently accommodates container necks of different diameters and facilitates pouring of all the liquid from the pouch into the container.

As discussed initially herein above, many prior spout designs have experienced a problem with blockage during the pouring process because the opening of the spout is too small and the walls of the spout tend to close upon themselves. The novel self opening spout 40 shown in FIGS. 1–3 overcomes those problems and enables all the liquid to be poured from the pouch. Upper edge 22 constitutes a multiple or pleated fold assembly 50 formed by doubling the plastic material inwardly upon itself into generally V-shaped configuration to provide pleated sections 52 and 54 of substantially uniform depth and joined to each other and to walls 24 and 26 along fold lines 56, 58 and 60 which extend transversely across the total width of the pouch, the fold assembly forming the upper portion of spout 40. As shown in FIG. 1 sealed side edge 28 extends to the very top of edge 22 thereby sealing the back edge of fold 50. Similarly, the sealed front edge 42 of spout 40 closes opening 43 and the front edge of fold assembly 50. The one piece pleated fold assembly 50 itself forms the seal across the top edge 22.

When it is desired to empty the liquid in pouch 20 into a container, the sealed edge 42 is cut off and the spout opens immediately due to the expansion of and the resilient spring force provided by fold assembly 50. As shown in FIG. 3 because of the excess fold material the opening 43 is large and the spring loaded fold assembly prevents the opening from closing as the liquid is poured from the pouch. Consequently, all the liquid in pouch 20 may be emptied into a container.

Figure 2:
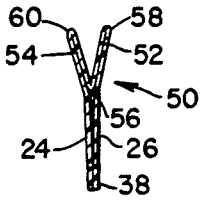
FIG. 2 is a fragmentary sectional view taken along line 2—2 of FIG. 1.
Figures 10, 11, 12:
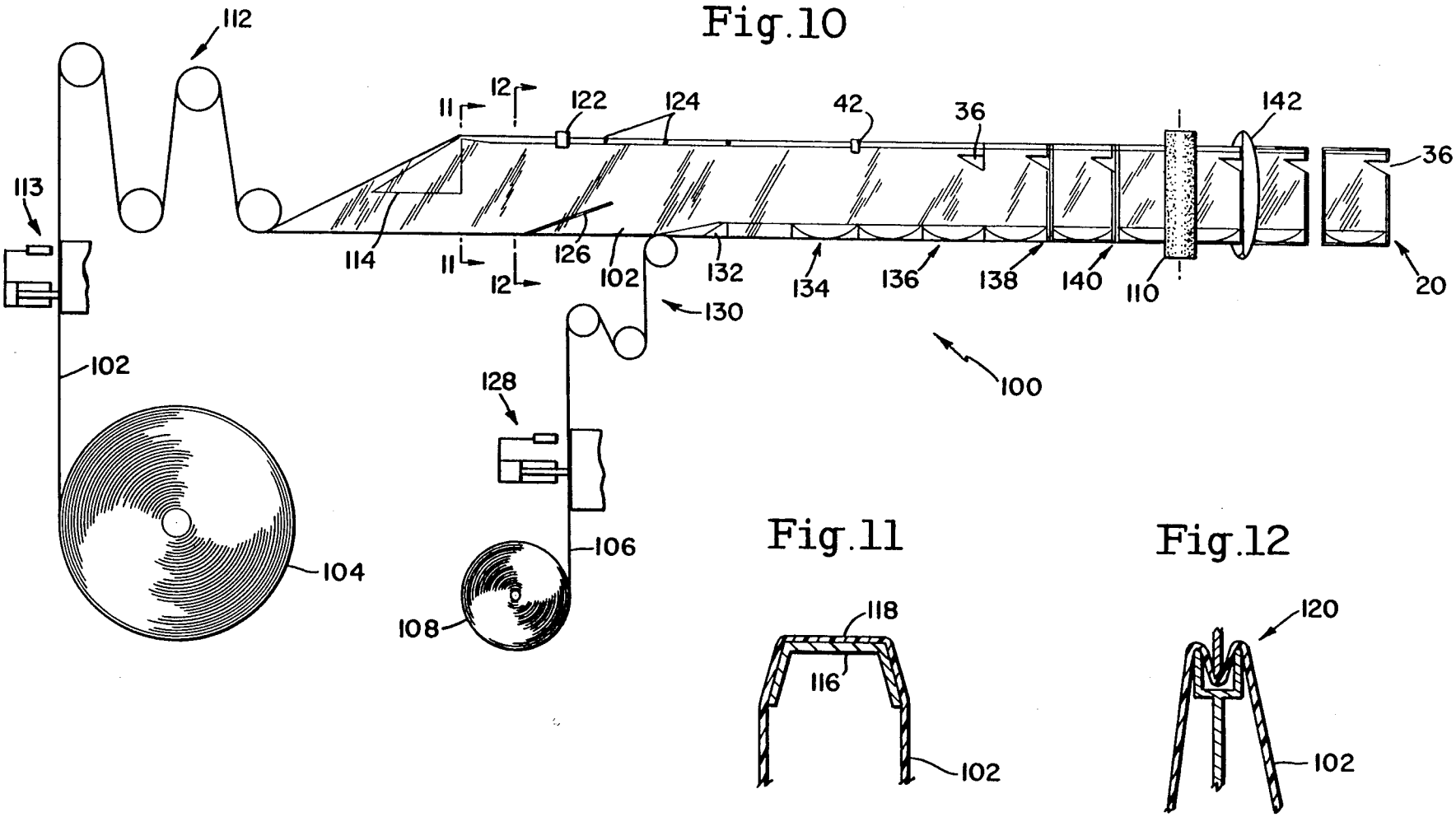
FIG. 10 is a schematic illustration of a manufacturing process and equipment by which the pouch illustrated in FIGS. 1-3 may be produced.
FIG. 11 is a fragmentary sectional view taken along line 11—11 of FIG. 10.
FIG. 12 is a fragmentary sectional view taken along line 12—12 of FIG. 10.

The pouch illustrated in FIGS. 1–3 may be manufactured using bag making apparatus 100 shown schematically in FIGS. 10–12. The main body of pouch 20 is formed from a continous main web 102 of plastic material unrolled from a coil 104. The gusset 34 is formed from a second web 106 of plastic material unrolled from a coil 108. Web 106 is narrower in width than web 102. A drive roller assembly 110 intermittently advances the webs through the various operating stations of apparatus 100.

Web 102 is advanced from coil 104 to a tension roller assembly 112 which keeps the web taught so that an air actuated male/female die punch assembly 113 can create top side seal holes in the web by which the upper side edge of the pouch may be subsequently tacked. After web 102 leaves the last roller of assembly 112, it is drawn over a forming plow 114 which folds the web in half into an inverted U-shape open at the bottom. The tail edge of plow 114 enlarges into a flat section 116 (FIG. 11) to form a flat 118 on the top of the web and provide an excess of material. The web is then advanced into another plow assembly 120 (FIG. 12) which doubles the flat 118 inwardly upon itself to form the V-shaped pleated fold assembly 50. Immediately upon leaving plow assembly 120, a heat sealing bar 122 tacks the fold assembly 50 at predetermined spaced intervals 124 to ensure that the assembly does not unfold.

The bottom edges of folded web 102 are spread open by a spreader bar assembly 126 to allow for the introduction and positioning of the bottom gusset. The gusset web 106 is passed through a die punch assembly 128, a tension roller assembly 130, and then over a folding plow 132 by which it is folded in half in a U-shape and positioned vertically between the open bottom edges of folded web 102. The bottom gusset 34 is heat sealed at seal station 134 at the same time that edge 42 of the spout is sealed. In the next station 136 the bottom gusset is cooled and the recess area 36 is die cut. The side edges 30 and 28 are then sealed and cooled at stations 138 and 140, and finally the web is cut at station 142 into individual pouches. Each pouch remains open at recess 36 to permit subsequent filling.

The process and apparatus of FIG. 10 are related to other process and apparatus for producing pouches. However, the novel design of plow assemblies 114, 116, and 120 which cooperate to form the V-shaped fold assembly 50 along the top of the pouch is a distinct advance in the art.

Figure 4:
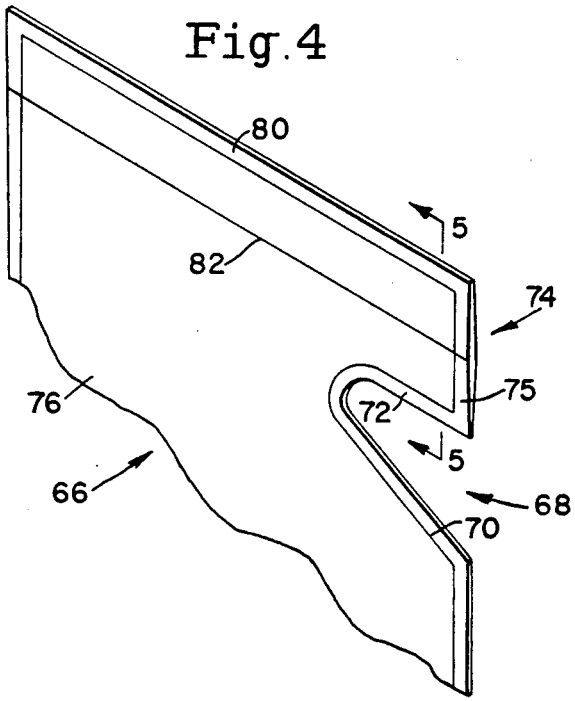
FIG. 4 is a fragmentary side perspective view of a second embodiment of the folded pouring spout of the invention in a sealed condition.
Figure 5:
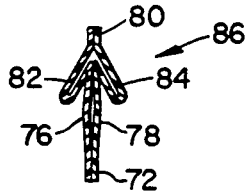
FIG. 5 is a fragmentary sectional view taken along line 5—5 of FIG. 4.
Figure 6:
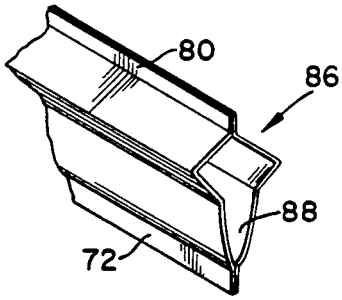
FIG. 6 is a fragmentary side perspective view illustrating the spout of FIG. 4 in an open pouring condition.

Referring now to FIGS. 4–6 a second embodiment of the invention includes a pouch 66 similar in construction to pouch 20 and having a recess 68 with sealed edges 70 and 72 and a spout 74 having a sealed front edge 75. Pouch 66 however is formed from two separate sheets 76 and 78 of flexible plastic material sealed together around their peripheral edges including their top edges 80 to form the closed chamber within the pouch. Below top edge 80 each sheet has a wall portion 82 and 84, respectively, folded outwardly and doubled back and under upon itself and extending across the width of the pouch to form a fold assembly 86 defining the upper portion of spout 74.

When the front sealed edge 75 is cut off, fold assembly 86 springs open and expands to the position of FIG. 6 providing a large spout opening 88. During the pouring operation, the spring force of fold assembly 86 keeps the spout open and enables all the liquid to be emptied from the pouch.

Figure 7:
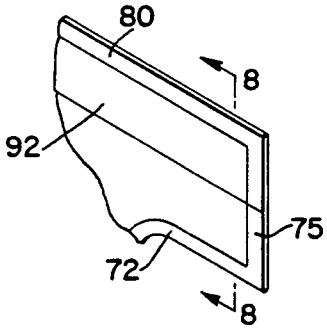
FIG. 7 is a fragmentary side perspective view of a third embodiment of the folded pouring spout of the invention in a sealed condition.
Figure 8:
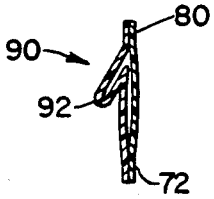
FIG. 8 is a fragmentary sectional view taken along line 8—8 of FIG. 7.
Figure 9:
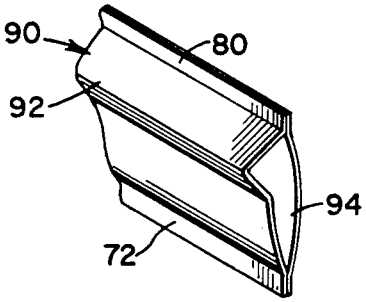
FIG. 9 is a fragmentary side perspective view illustrating the spout of FIG. 7 in an open pouring condition.

The embodiment of the invention illustrated in FIGS. 7–9 is the same as that of FIGS. 4–6 except that a fold assembly 90 is formed by doubling back upon itself a portion 92 of only one of the walls of the pouch. When the front sealed edge of the spout is cut off the fold assembly springs open to provide a large opening 94 as shown in FIG. 9.

The pouch embodiments of FIGS. 4–6 and FIGS. 7–9 may be manufactured by equipment similar to that of FIG. 10, but with properly designed plow assemblies to produce the desired folds.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A flexible pouch comprising first and second opposed wall means joined at a top edge and closed together around their periphery to define a chamber for storing a product, said wall means having wall portions thereof forming spout means by which the product may be poured from said chamber, seal means normally closing said spout means, at least one of said wall portions forming said spout means and including a fold assembly adjacent said top edge extending transversely the length of said spout means and maintained in a substantially folded condition when said spout means is sealed, said fold assembly expanding and causing said spout means to open upon removal of said seal means.

2. The flexible pouch of claim 1, comprising recess means adjacent said spout means, said recess means of a shape for accommodating a neck of a container as the product is poured from said spout means into said container.

3. The flexible pouch of claim 2, said pouch being generally rectangular in shape and having an end edge and side edges, said recess means being provided in one of said side edges and said spout means being formed at one corner of said pouch between said end edge and said recess means.

4. The flexible pouch of claim 3, said fold assembly extending transversely between said side edges.

5. The flexible pouch of claim 1, said first and second wall means being formed from a single sheet of material bent upon itself along said fold assembly and closed around its peripheral edges, said fold assembly including portions of said material folded inwardly into generally V-shaped configuration and providing a resilient spring force which opens said spout means upon removal of said seal means.

6. The flexible pouch of claim 5, said fold assembly including outwardly folded sections of each of said sheets maintained in a substantially folded condition when said spout means is sealed, said sections expanding to open said spout means when said seal means is removed.

7. The flexible pouch of claim 5, said fold assembly including an outwardly folded section of at least one of said sheets maintained in a substantially folded condition when said spout means is sealed, said section expanding to open said spout means when said seal means is removed.

8. The flexible pouch of claim 1, said first and second wall means being formed from two opposed sheets of material closed together around their peripheral edges.

9. A flexible pouch comprising first and second side opposed wall means of generally rectangular configuration closed together around peripheral first and second side edges and top and bottom edges formed by a juncture of said first and second side opposed wall means to define a chamber for storing a product, said wall means having wall portions forming spout means at one corner thereof defined by said top edge and said first side edge, seal means normally closing said spout means, at least one of said wall portions having a fold assembly located adjacent said top edge and maintained in a substantially folded condition when said spout means is sealed, said fold assembly expanding and causing said spout means to open upon removal of said seal means.

10. The flexible pouch of claim 9, comprising recess means in said first side edge adjacent said spout means, said recess means of a shape for accommodating a neck of a container as the product is poured through said spout means into said container.

11. The flexible pouch of claim 9, said first and second wall means being formed from a single sheet of material bent upon itself along said fold assembly and closed around its peripheral edges, said fold assembly including portions of said material folded inwardly along said top edge into generally V-shaped configuration and providing a resilient spring force which opens said spout means upon removal of said seal means.

12. The flexible pouch of claim 11, said fold assembly being of substantially uniform depth and extending from said first side edge across said wall means to said second side edge.

13. The flexible pouch of claim 11, said first and second wall means being formed from two opposed sheets of material closed together around their peripheral edges.

14. The flexible pouch of claim 13, said fold assembly including outwardly folded sections of each of said sheets maintained in a substantially folded condition when said spout means is sealed, said sections expanding to open said spout means when said seal means is removed.

15. The flexible pouch of claim 14, said fold assembly being of substantially uniform depth and extending from said first side edge and across said wall means to said second side edge.

16. The flexible pouch of claim 13, said fold assembly including an outwardly folded section of at least one of said sheets maintained in a substantially folded condition when said spout means is sealed, said section expanding to open said spout means when said seal means is removed.

17. The flexible pouch of claim 16, said fold assembly being of substantially uniform depth and extending from said first side edge and across said wall means to said second side edge.

* * * * *